US007586460B2

(12) United States Patent
Hunt et al.

(10) Patent No.: US 7,586,460 B2
(45) Date of Patent: Sep. 8, 2009

(54) DONGLE DEVICE WITH INTEGRATED ANTENNA ASSEMBLY

(75) Inventors: Charles Curtiss Hunt, Wake Forest, NC (US); Gerard James Hayes, Wake Forest, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 71 days.

(21) Appl. No.: 11/873,430

(22) Filed: Oct. 17, 2007

(65) Prior Publication Data

US 2009/0096681 A1 Apr. 16, 2009

Related U.S. Application Data

(60) Provisional application No. 60/980,012, filed on Oct. 15, 2007.

(51) Int. Cl.
*H01Q 3/02* (2006.01)
*H01Q 7/00* (2006.01)
*H01Q 1/50* (2006.01)

(52) U.S. Cl. ..... 343/882; 343/869; 343/906

(58) Field of Classification Search ..... 343/700 MS, 343/869, 702, 878, 882, 872, 879, 906
See application file for complete search history.

(56) References Cited

U.S. PATENT DOCUMENTS

D444,788 S 7/2001 Do et al.
6,544,075 B1 * 4/2003 Liao ..... 439/638
6,545,643 B1 * 4/2003 Sward et al. ..... 343/702
6,612,874 B1 * 9/2003 Stout et al. ..... 439/640
6,758,689 B1 7/2004 Bair et al.
7,441,266 B2 * 10/2008 Kurian et al. ..... 726/9
2004/0263417 A1 12/2004 Sanchez et al.
2005/0161513 A1 7/2005 Huang et al.
2006/0079189 A1 4/2006 Watanabe et al.

FOREIGN PATENT DOCUMENTS

CN 200 941 307 8/2007
WO 2006/022353 3/2006

OTHER PUBLICATIONS

International Search Report and Written Opinion for corresponding application No. PCT/US2008/060633 dated Jul. 16, 2008.

* cited by examiner

*Primary Examiner*—Shih-Chao Chen
(74) *Attorney, Agent, or Firm*—Renner, Otto, Boisselle & Sklar, LLP

(57) ABSTRACT

An electronic device includes a main body having electronic circuitry therein, and further includes an exposed interface that enables the electronic circuitry to transfer information. In addition, the electronic device includes a pivoting member attached to the main body such that the pivoting member may rotate about the main body between at least a first position and a second position, the pivoting member including at least one antenna element. The pivoting member covers the exposed interface when in the first position, and when the pivoting member is in the second position, the antenna element serves as an antenna for transmitting and/or receiving information wirelessly in conjunction with the electronic circuitry.

19 Claims, 5 Drawing Sheets

DONGLE DEVICE WITH INTEGRATED ANTENNA ASSEMBLY

RELATED APPLICATION DATA

The present application claims the benefit of U.S. Provisional Application Ser. No. 60/980,012, filed Oct. 15, 2007, the disclosure of which is herein incorporated by reference in its entirety.

TECHNICAL FIELD OF THE INVENTION

The present invention relates generally to wireless electronic devices, and more particularly to antennas used in conjunction with a dongle device.

DESCRIPTION OF THE RELATED ART

As is known, for communication devices (e.g., computers, cellular telephones, printers, game consoles, control devices, personal digital assistants, etc.) to communicate, they need a wired or wireless connection. As is also known, there are many standards that dictate the signaling protocol and/or hardware protocol for wired communications and wireless communications. Furthermore, many massed produced devices, such as computers, PDAs, cellular telephones, etc., include communication circuitry to support one or more wired and/or wireless standards. Such wired standards include Ethernet, universal serial bus (USB), fire wire, etc., and wireless standards include IEEE 802.11, Bluetooth, and extensions thereof, etc.

Situations oftentimes arise when it is desirable to equip a communication device with a wireless adapter to enable the communication device to communicate via one of the wireless standards or the like. Such wireless adapters can be in the form of a universal serial bus (USB) dongle that incorporates an IEEE 802.11, Bluetooth, or other type wireless interface, as are known. The USB dongle includes a USB connector for engaging a corresponding USB connector in the communication device, such as a personal computer. Within the dongle is electronic circuitry that serves as an interface between the communication device and a wireless network.

In order to enable the electronic circuitry to communicate over the wireless network, the USB dongle or other type portable wireless adapter includes at least one antenna therein. The electronic circuitry uses the antenna to transmit and/or receive information wirelessly via the network.

USB dongles and other portable wireless adapters typically have a small profile by design. Otherwise, the adapters tend to occupy an undesirable amount of space. For example, the further the body of a USB dongle extends from the USB port of a communication device, the more likely the dongle will inadvertently become caught on an obstruction and perhaps broken. Furthermore, the larger the USB dongle or other type adapter, the less convenient it is to transport and store the adapter (e.g., in one's shirt pocket). Moreover, smaller dongles are typically considered more attractive cosmetically.

Due to these types of mechanical and/or cosmetic constraints on the size of the USB dongle or other portable wireless adapter, the availability of space therein for the antenna is limited. The antenna must share space within the adapter with the remaining electronic circuitry. Consequently, the antenna must be relatively small in order to fit within the available space. On the other hand, such a small antenna offers a relatively low, and perhaps insufficient, amount of gain thereby reducing the range of the wireless adapter. Thus, while users typically prefer that the wireless adapter provide extended range, the mechanical and/or cosmetic constraints placed on the antenna can limit range undesirably.

In view of the aforementioned shortcomings of USB dongles and other portable wireless adapters and devices, there is a strong need in the art for a construction that provides a small profile without necessarily sacrificing the size and gain of the antenna.

SUMMARY

According to one aspect of the invention, an electronic device, comprises a main body including electronic circuitry therein, and further including an exposed interface that enables the electronic circuitry to transfer information. A pivoting member is attached to the main body that may be rotated about the main body between at least a first position and a second position, the pivoting member including at least one antenna element. The pivoting member covers the exposed interface when in the first position, and when the pivoting member is in the second position, the pivoting member serves as an antenna for transmitting and/or receiving information wirelessly in conjunction with the electronic circuitry.

In one embodiment of the electronic device, the at least one antenna element substantially wraps around the pivoting member.

In one embodiment of the electronic device, the pivoting member contains a plurality of antennae elements, and the plurality of antennae elements each wrap around the pivoting member.

In one embodiment of the electronic device, the at least one antenna element is contained wholly within one side of the pivoting member.

In one embodiment of the electronic device, the pivoting member has a plurality of antennae, and at least two of the antennae are located on different sides of the pivoting member.

In one embodiment of the electronic device, the pivoting member is made of a dielectric material and the at least one antenna element is embedded within the dielectric material.

In one embodiment of the electronic device, the main body has an elongate shape, and the exposed interface is an electrical interface connector for connecting the electronic circuitry to another device when the pivoting member is in the second position.

In one embodiment of the electronic device, the electrical interface connector comprises a USB connector.

In one embodiment of the electronic device, the main body is a dongle.

In one embodiment of the electronic device, the electronic device is a wireless interface.

In one embodiment of the electronic device, the electronic device serves as an interface between another device connected to the exposed interface and a wireless network.

In one embodiment of the electronic device, the wireless network comprises an IEEE 802.11 network.

In one embodiment of the electronic device, the wireless network comprises a mobile phone network.

In one embodiment of the electronic device, the wireless network comprises a Bluetooth network.

In one embodiment of the electronic device, the pivoting member rotates about a pivoting mechanism that is in communication with the electronic circuitry.

In one embodiment of the electronic device, an RF connection is established between the electronic circuitry and the at least one antenna element via the pivoting mechanism.

In one embodiment of the electronic device, the pivoting mechanism is a rotating hinge.

In one embodiment of the electronic device, the pivoting member wraps around the main body such that when the pivoting member is in the first position, the pivoting member is wrapped around the entire main body in a longitudinal direction.

In one embodiment of the electronic device, the pivoting member has a width substantially the same as a width of the main body.

In one embodiment of the electronic device, the pivoting member rotates about the center of the main body and in substantially the same plane as a longitudinal direction of the main body.

In one embodiment of the electronic device, the pivoting member rotates off-center relative to the main body and in the substantially the same plane as a longitudinal direction of the main body, such that when the pivoting member is in the second position, the pivoting member and the main body are in substantially an L-shaped configuration.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

It should be emphasized that the term "comprises/comprising" when used in this specification is taken to specify the presence of stated features, integers, steps or components but does not preclude the presence or addition of one or more other features, integers, steps, components or groups thereof.

DETAILED DESCRIPTION OF EMBODIMENTS

The present invention will now be described with reference to the drawings, in which like reference labels are used to refer to like elements throughout.

Figure 1:
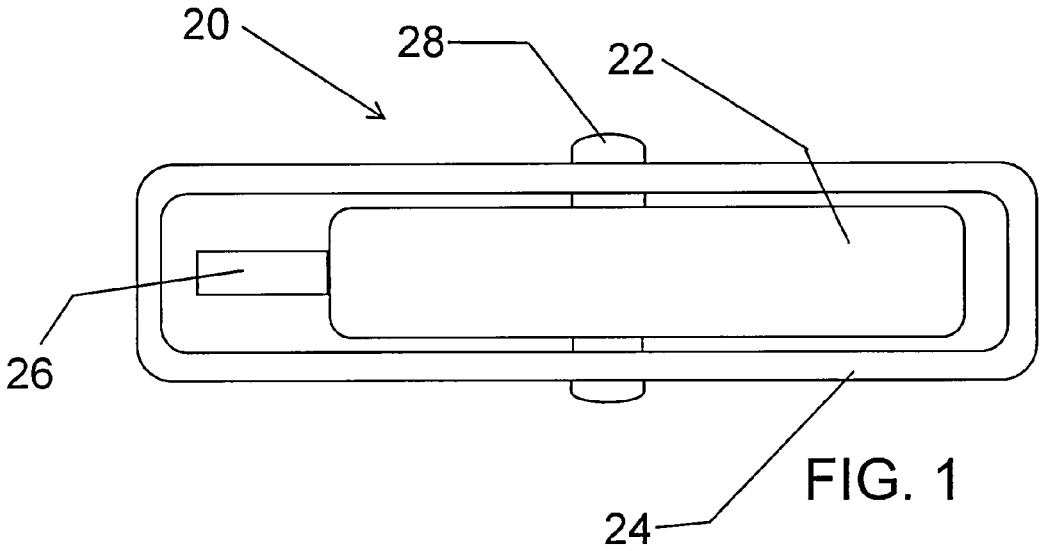
FIG. 1 is a schematic view of an electronic device including a pivoting member having an integrated antenna in a first position according to an embodiment of the invention.
Figure 2:
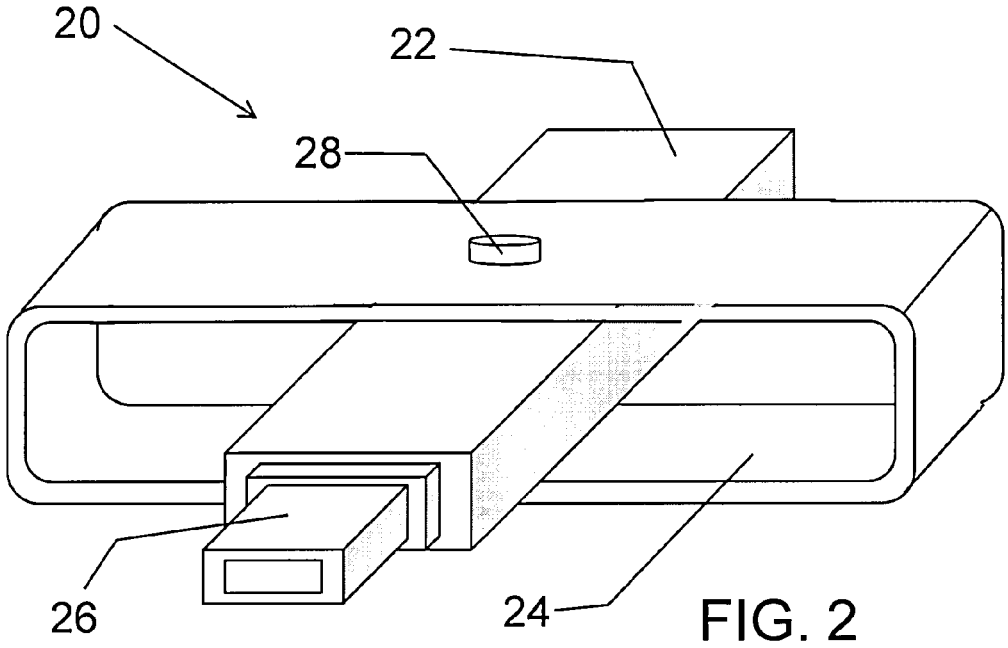
FIG. 2 illustrates the electronic device of FIG. 1 with the pivoting member in a second position in accordance with an embodiment of the invention.

Referring initially to FIGS. 1 and 2, an electronic device 20 is shown in accordance with an exemplary embodiment of the present invention. According to this particular embodiment, the electronic device 20 is a USB dongle. It will be appreciated, however, based on the disclosure presented herein, that the invention also has utility with various other types of electronic devices which may utilize a pivoting member and antenna. The present invention, in its broadest sense, is not limited to any particular type of electronic device.

The USB dongle 20 includes a main body 22 and a pivoting member 24 attached to the main body in a manner such that the pivoting member 24 may be rotated about the main body between at least a first position and a second position. In an exemplary embodiment, the pivoting member 24 pivots about the main body 22 via a pivot mechanism 28. Included within the main body 22 is electronic circuitry (not shown in this figure) that enables the USB dongle 20 to function as an IEEE 802.11, a Bluetooth wireless adapter, or other wireless adapter for providing wireless service connectivity. The main body 22 has an elongate shape and includes an exposed mechanical interface 26 such as a USB style plug. The interface 26 is designed to fit into the USB port of another electronic device (not shown), such as a personal computer, notebook computer, mobile phone, personal digital assistant, etc. As is known, the interface 26 enables the electronic circuitry within the dongle 20 to communicate and transfer information to another electronic device.

Figure 3:
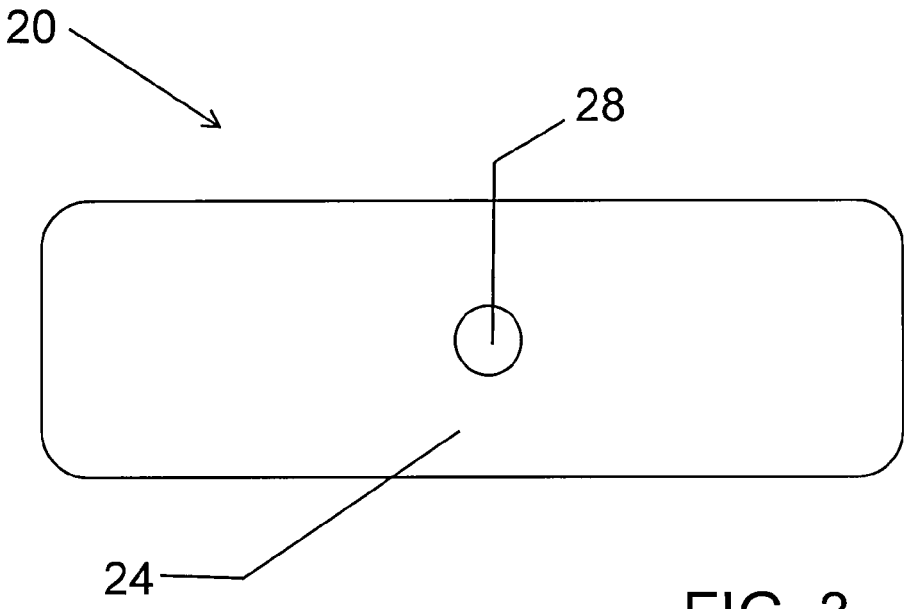
FIG. 3 is a top schematic view of the electronic device of FIG. 1 with the pivoting member in the first position in accordance with an embodiment of the invention.

The pivoting member 24 is configured so as to be rotated about the main body 22 from at least a first substantially closed position as shown in FIG. 1, to a second substantially open position as shown in FIG. 2. As will be described in more detail below, the pivoting member 24 of the present invention includes an antenna element or elements integrated therein. To provide enhanced surface area to increase the permissible size of the antenna elements, the pivoting member 24 has a width substantially the same as the width of the main body 22. As shown in FIGS. 1 and 3, the pivoting member 24 may wrap around the main body 22 such that when the pivoting member is in the first position, the pivoting member is wrapped around the entire main body in a longitudinal direction. In this manner, when the pivoting member 24 is in the first position relative to the main body 22, the pivoting member 24 functions to cover the exposed interface 26. The pivoting member 24 thereby helps to prevent the interface 26 on the main body 22 from being damaged, collecting dust or debris, etc.

Figure 4:
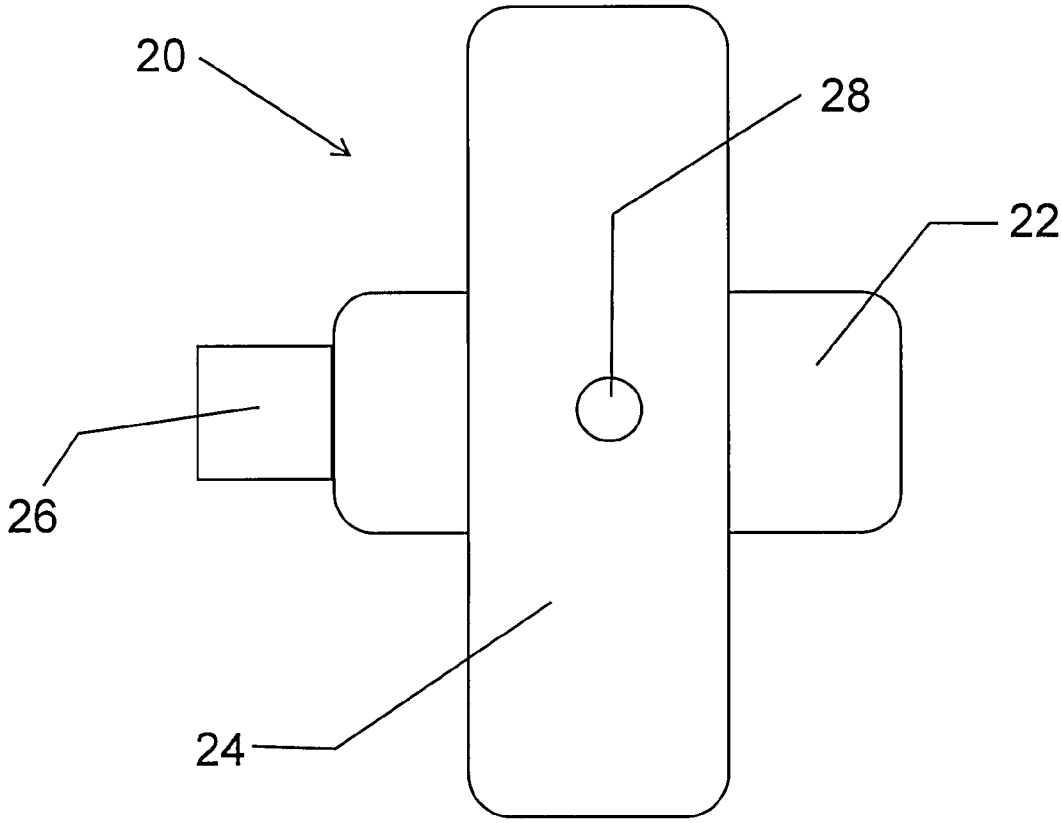
FIG. 4 is a top schematic view of the electronic device of FIG. 1 with the pivoting member in the second position in accordance with an embodiment of the invention.

Additionally, the pivoting member 24 may rotate about the center of the main body 22 and in substantially the same plane as the longitudinal direction of the main body. As further shown in FIGS. 2 and 4, when the pivoting member 24 is rotated to the second position relative to the main body 22, the antenna element serves as an antenna for transmitting and/or receiving information wirelessly in conjunction with the electronic circuitry included in the main body 22. As further described below, the antenna elements of pivoting member 24 are in communication with circuitry in the main body 22 via the pivoting mechanism 28. As a result, the antenna in the pivoting member 24 is operative as an antenna without occupying space within the main body 22. This enables the dongle 20 to possess a larger antenna within the pivoting member 24 to provide better gain than an antenna limited in size by the space available in the main body 22. In addition, or in the alternative, the overall size of the main body 22 may be reduced compared to a conventional device in the sense that the main body 22 no longer must house the antenna itself. The shape and size of the antenna element is limited only by the size of the pivoting member 24. The antenna element within the pivoting member 24 may represent the entire antenna for the electronic circuitry in the main body 22, an extension of an existing antenna within the main body 22, or simply an antenna in addition to the antenna already existing within the main body 22.

Figure 5A:
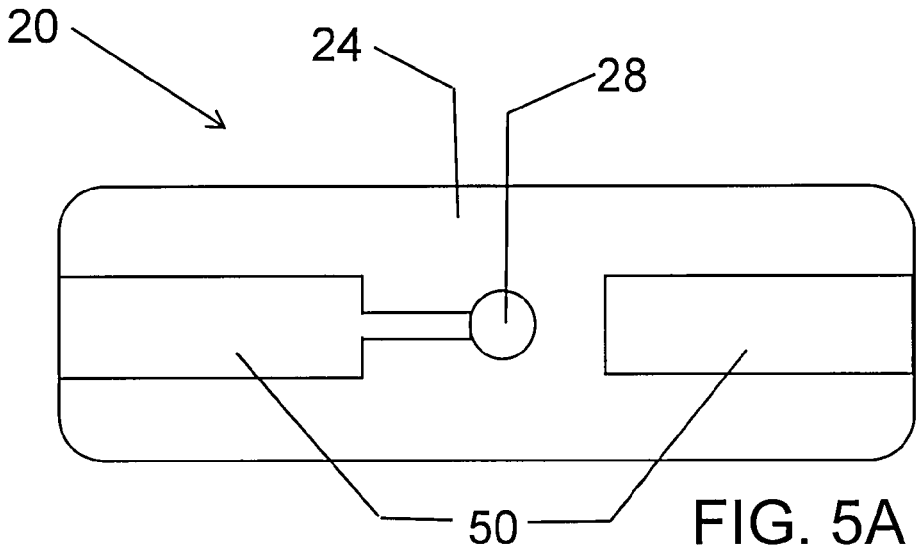
FIGS. 5A-C illustrate schematically top cross-sectional views of the pivoting member with various antenna configurations in accordance with embodiments of the invention.
Figure 5B:
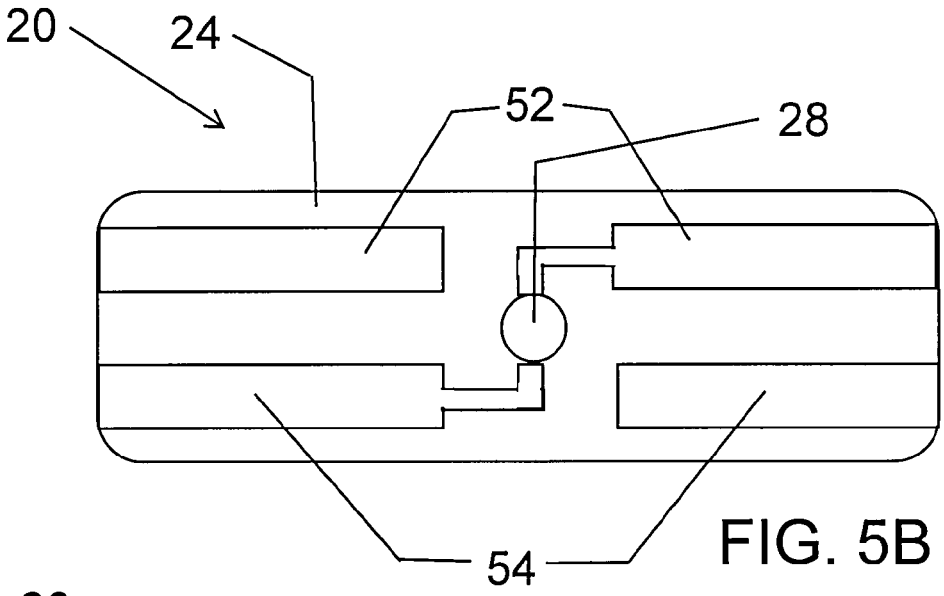
Figure 5C:
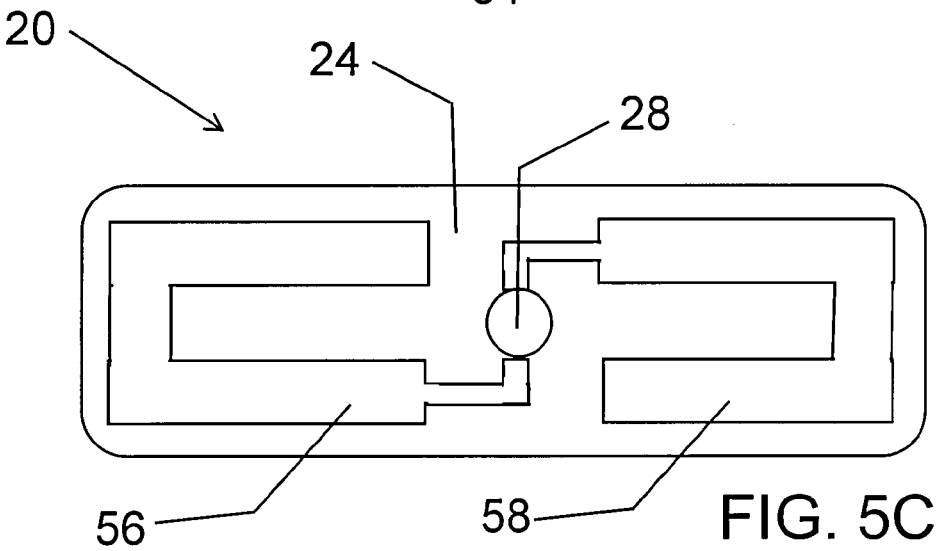

FIGS. 5A-C depict various exemplary antenna configurations within the pivoting member 24. In each of these embodiments, the antenna elements may be of an electrically conductive wire, and may be of a helix antenna or other configuration as is known in the art. The pivoting member 24 is made of an RF-compatible dielectric material such as plastic or the like. In an exemplary embodiment, the antenna elements are embedded within the dielectric material by molding them within a plastic pivoting member 24. Other mechanisms of incorporating the antenna elements may be employed, such as by plating, trapping flex elements into a housing, or others. The antenna elements are coupled via the pivoting mechanism 28 to the electronic circuitry elements contained within the main body 22.

FIG. 5A depicts an embodiment in which the pivoting member 24 includes a single antenna element 50. The antenna element 50 is coupled at one end to the pivoting mechanism 28, and substantially wraps around the pivoting member 24 ending adjacent the other side of the pivoting mechanism 28. FIG. 5B depicts a dual-antenna configuration in which the pivoting member 24 contains two antenna elements 52 and 54. Each antenna element 52 and 54 is coupled at one end to the pivoting mechanism 28 and substantially wraps around the pivoting member 24 similar to the antenna element of FIG. 5A. FIG. 5C depicts an embodiment in which dual antenna elements 56 and 58 are contained wholly within the top side of the pivoting member 24, each antenna element having one end coupled to the pivoting mechanism 28. It will be appreciated that the bottom side of pivoting member 24 may similarly contain antenna elements, each having one end coupled to the pivoting mechanism 28. In one embodiment, the top and bottom sides of pivoting member 24 each contain two antenna elements, creating a quad-antenna configuration. Those having ordinary skill in the art will appreciate that the particular number, type, and configuration of antenna elements included in the pivoting member 24 need not be limited in the broadest sense of the invention.

In the multiple antennae configurations, one antenna may act as a main antenna while additional one or more antennae may act as diversity antennae. The diversity antennae may be dedicated to specific functions such as MIMO, MTV, GPS, and others as are known in the art, or as may become available in the future.

Figure 6:
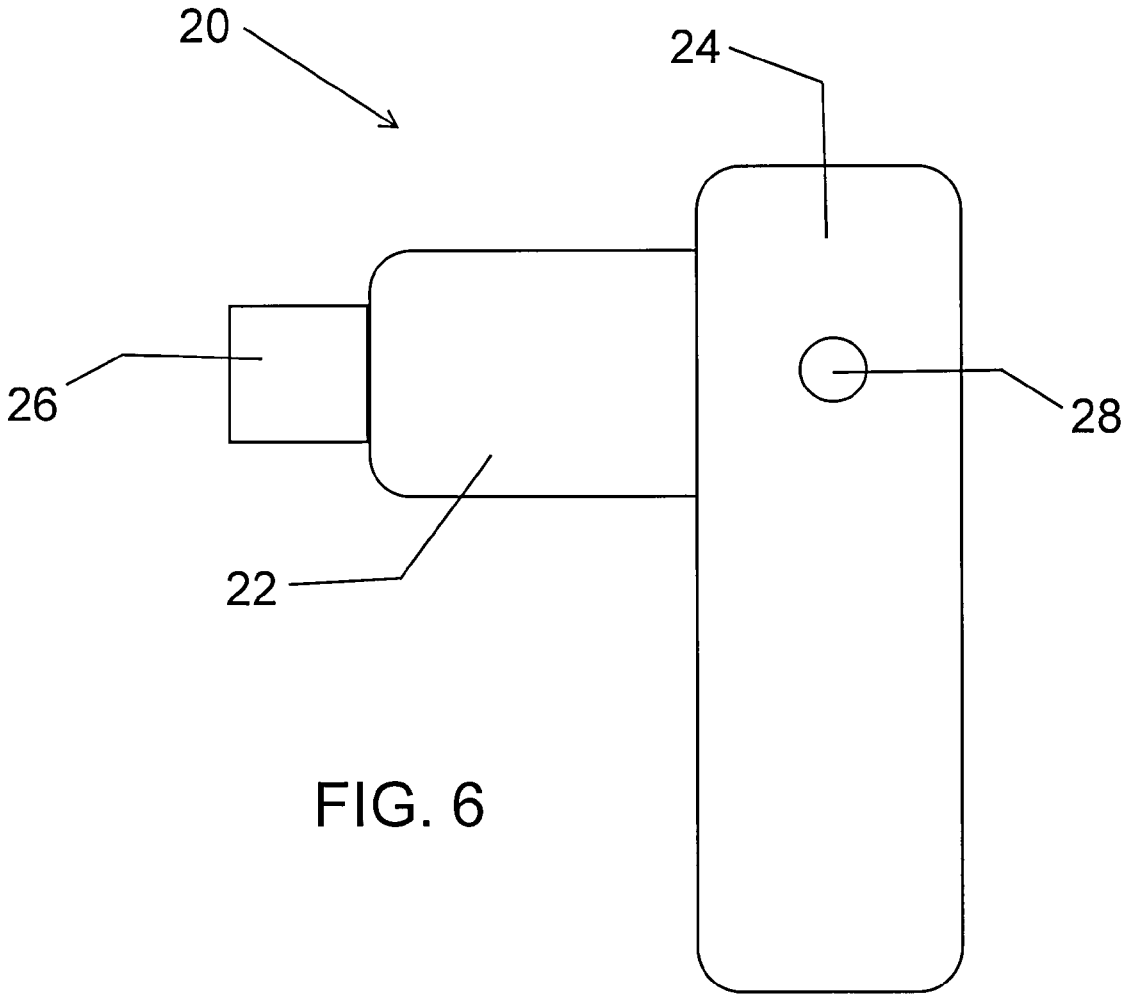
FIG. 6 is a schematic view of an electronic device including a pivoting member having an integrated antenna according to an alternative embodiment of the invention.

Referring to FIG. 6, an alternative embodiment is shown. In this embodiment, the pivoting mechanism 28 is located adjacent the end of the main body 22 opposite the mechanical interface 26. Thus, the pivoting member 24 may rotate off-center relative to the main body and in substantially the same plane as the longitudinal direction of the main body. In this manner, when in the second position, the main body 22 and pivoting member 24 may form a substantially "L-shaped" configuration. In this embodiment, the pivoting member 24 may contain one or more antenna elements configured comparably as in previous embodiments. One or more antenna elements, each having one end coupled to the pivoting mechanism 28, either may wrap around the pivoting member 24, or be contained wholly within either the top or bottom portions of the pivoting member 24.

Figure 7:
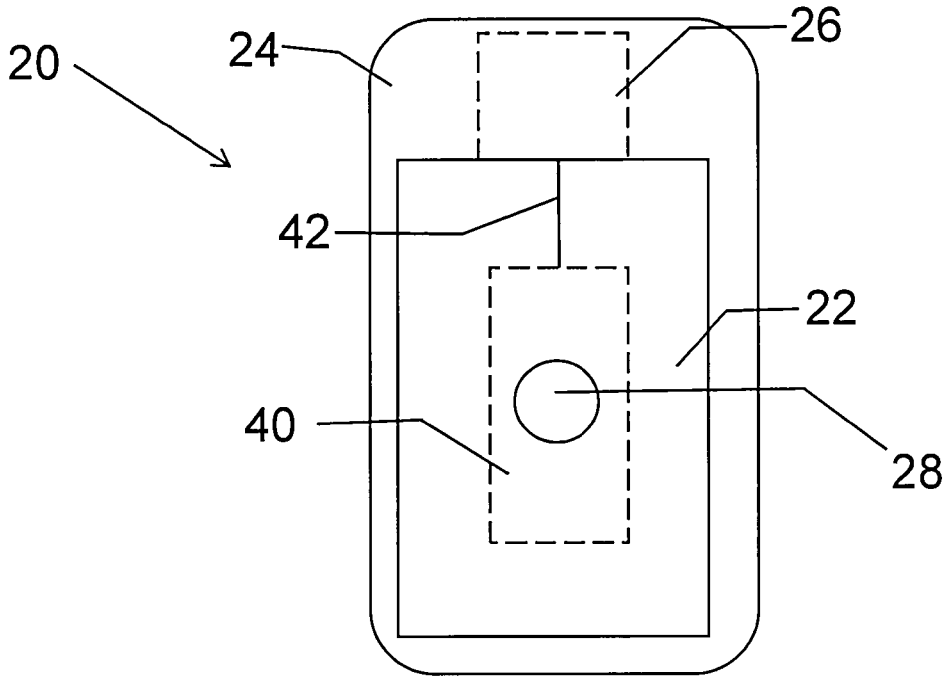
FIGS. 7 and 8 are schematic cross-section diagrams of the electronic device of FIG. 1 with the pivoting member in the first position and second position, respectively, in accordance with embodiments of the invention.
Figure 8:
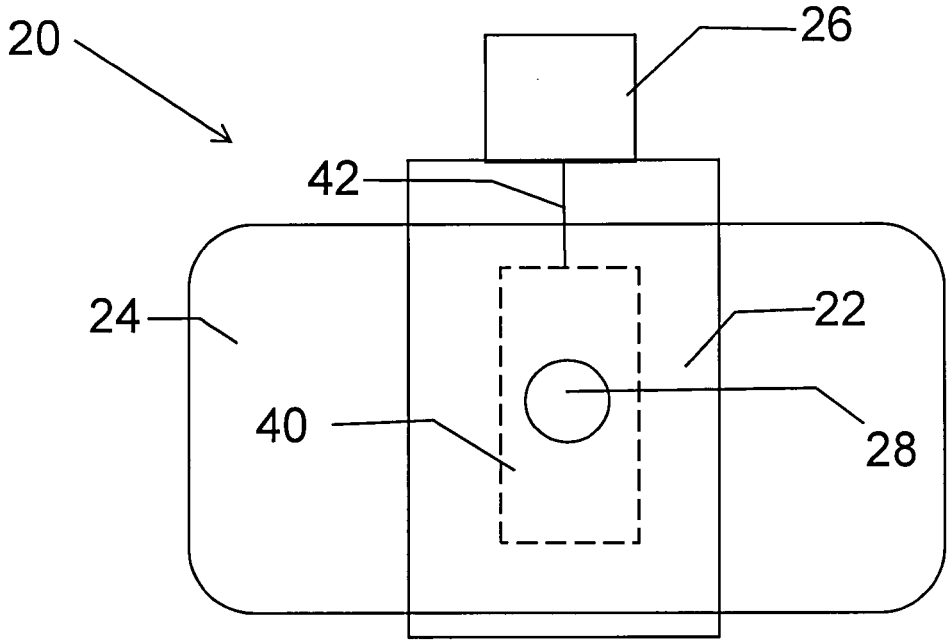

FIGS. 7 and 8 illustrate schematically the electronic device 20 with the pivoting member 24 in the first and second positions respectively. The main body 22 includes electronic circuitry 40 connected to the interface 26 via bus 42 for communicating with a personal computer, notebook computer, mobile telephone, or any other electronic device connected thereto. The electronic circuitry enables the USB dongle 20 to function as an IEEE 802.11, Bluetooth, or other wireless adapter for providing wireless connectivity to a network. Those skilled in the art will appreciate the precise configuration of the electronic circuitry 40, and therefore for simplicity the details of such circuitry are not included herein. The pivoting mechanism 28 is in communication with the electronic circuitry 40. Thus, the pivoting mechanism 28 establishes a radio frequency (RF) connection between the electronic circuitry 40 and the antenna elements within the pivoting member 24. Various connection schemes may be employed via pivoting mechanism 28 to establish the RF connection between the electronic circuitry 40 and the antenna elements. For example, a coaxial or flex cable may run along or through a rotating pin or hinge as the pivoting mechanism 28. Alternatively, pogo-pin or spring contacts at select locations around the pivot axis may be employed, which cooperate with opposite contacts within the main body 22. Those skilled in the art will understand various ways by which an RF connection may be established between the antenna elements and the electronic circuitry 40 via the pivoting mechanism 28.

Accordingly, the present invention provides a construction for USB dongles and other portable devices that enables a small profile without necessarily sacrificing the size and gain of the antenna. The term "electronic device" as referred to herein includes wireless adapters and other types of portable radio communication equipment. The term "portable radio communication equipment", also referred to herein as a "mobile radio terminal", includes all equipment such as mobile phones, pagers, communicators, e.g., electronic organizers, personal digital assistants (PDAs), smartphones or the like.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. An electronic device, comprising:

a main body including electronic circuitry therein, and further including an exposed interface that enables the electronic circuitry to transfer information; and a pivoting member attached to the main body that may be rotated about the main body in substantially the same plane as a longitudinal direction of the main body between at least a first position and a second position, the pivoting member including at least one antenna element, wherein the pivoting member wraps around the entire main body in a longitudinal direction and covers the exposed interface when in the first position; and when the pivoting member is in the second position, the antenna element serves as an antenna for transmitting and/or receiving information wirelessly in conjunction with the electronic circuitry.

2. The electronic device of claim 1, wherein the at least one antenna element substantially wraps around the pivoting member.

3. The electronic device of claim 2, wherein the pivoting member contains a plurality of antennae elements, and the plurality of antennae elements each wrap around the pivoting member.

4. The electronic device of claim 1, wherein the at least one antenna element is contained wholly within one side of the pivoting member.

5. The electronic device of claim 4, wherein the pivoting member has a plurality of antennae, and at least two of the antennae are located on different sides of the pivoting member.

6. The electronic device of claim 1, wherein the pivoting member is made of a dielectric material and the at least one antenna element is embedded within the dielectric material.

7. The electronic device of claim 1, wherein the main body has an elongate shape, and the exposed interface is an electrical interface connector for connecting the electronic circuitry to another device when the pivoting member is in the second position.

8. The electronic device of claim 7, wherein the electrical interface connector comprises a USB connector.

9. The electronic device of claim 1, wherein the electronic device is a wireless interface.

10. The electronic device of claim 9, wherein the electronic device serves as an interface between another device connected to the exposed interface and a wireless network.

11. The electronic device of claim 10, wherein the wireless network comprises an IEEE 802.11 network.

12. The electronic device of claim 10, wherein the wireless network comprises a mobile phone network.

13. The electronic device of claim 10, wherein the wireless network comprises a Bluetooth network.

14. The electronic device of claim 1, wherein the pivoting member rotates about a pivoting mechanism that is in communication with the electronic circuitry.

15. The electronic device of claim 14, wherein an RF connection is established between the electronic circuitry and the at least one antenna element via the pivoting mechanism.

16. The electronic device of claim 14, wherein the pivoting mechanism is a rotating hinge.

17. The electronic device of claim 1, wherein the pivoting member has a width substantially the same as a width of the main body.

18. The electronic device of claim 1, wherein the pivoting member rotates about the center of the main body and in substantially the same plane as a longitudinal direction of the main body.

19. The electronic device of claim 1, wherein the pivoting member rotates off-center relative to the main body and in the substantially the same plane as a longitudinal direction of the main body, such that when the pivoting member is in the second position, the pivoting member and the main body are in substantially an L-shaped configuration.

* * * * *